US008789574B2

(12) United States Patent
Ferguson

(10) Patent No.: US 8,789,574 B2
(45) Date of Patent: Jul. 29, 2014

(54) HARD AND SOFT WINDOW CORNICE KIT AND RETURN

(76) Inventor: Emily J Ferguson, Indianapolis, IN (US)

( * ) Notice: Subject to any disclaimer, the term of this patent is extended or adjusted under 35 U.S.C. 154(b) by 1762 days.

(21) Appl. No.: 12/015,124

(22) Filed: Jan. 16, 2008

(65) Prior Publication Data

US 2008/0179015 A1 Jul. 31, 2008

Related U.S. Application Data

(60) Provisional application No. 60/898,162, filed on Jan. 29, 2007.

(51) Int. Cl.
*A47H 2/00* (2006.01)

(52) U.S. Cl.
USPC ..... 160/38

(58) Field of Classification Search
USPC ..... 160/19, 38, 39, DIG. 16
See application file for complete search history.

(56) References Cited

U.S. PATENT DOCUMENTS

| | | | | | |
|---|---|---|---|---|---|
| 2,430,959 | A * | 11/1947 | Soff | 160/38 |
| 2,553,869 | A * | 5/1951 | Purcell | 160/38 |
| 2,588,243 | A * | 3/1952 | Irving | 160/19 |
| 2,602,500 | A * | 7/1952 | Slavin et al. | 160/38 |
| 3,131,811 | A * | 5/1964 | Miller | 206/577 |
| 4,246,951 | A * | 1/1981 | Givens | 160/39 |
| 4,976,301 | A * | 12/1990 | Easley et al. | 160/84.01 |
| 5,042,549 | A * | 8/1991 | Roberts | 160/39 |
| 5,996,791 | A * | 12/1999 | Bibby et al. | 206/326 |
| 6,085,821 | A * | 7/2000 | Roberts | 160/38 |
| 7,063,121 | B2 * | 6/2006 | Zorbas et al. | 160/38 |
| 2002/0007920 | A1 * | 1/2002 | Lower | 160/38 |
| 2004/0035534 | A1 * | 2/2004 | Owens et al. | 160/38 |
| 2006/0289130 | A1 * | 12/2006 | Zimmer | 160/330 |

* cited by examiner

*Primary Examiner* — David Purol

(74) *Attorney, Agent, or Firm* — Keith J. Swedo; Bingham Greenebaum Doll LLP

(57) ABSTRACT

A cornice includes a substantially U-shaped return having a substantially horizontal base plate with a first end and a second end. A first substantially vertical plate has an upper end attached to the first end of the base plate. A second substantially vertical plate has an upper end attached to the second end of the base plate. A façade is removably coupled to the return via at least one fastening device. Each fastening device is configured to be repeatedly fastened and unfastened.

5 Claims, 10 Drawing Sheets

HARD AND SOFT WINDOW CORNICE KIT AND RETURN

CROSS REFERENCE TO RELATED APPLICATION

This application claims benefit to U.S. Provisional Application Ser. No. 60/898,162, filed Jan. 29, 2007, which is incorporated by reference herein in its entirety.

BACKGROUND

The present invention relates to cornice kits.

A cornice is a structure that decoratively crowns a door or window.

SUMMARY

The present invention provides an affordable and easily applicable window cornice kit and return incorporating changeable and interchangeable front face facades of various predetermined and custom designs as well as enabling the effortless switching of soft cornice fabric finishes for seasonal and flexible decorating needs. The changeable feature is achieved by non-permanent bonding elements aligned to sufficiently close tolerance on the "return" and on the design-bearing "front face facade".

The invention comprises, in one form thereof, a cornice including a substantially U-shaped return having a substantially horizontal base plate with a first end and a second end. A first substantially vertical plate has an upper end attached to the first end of the base plate. A second substantially vertical plate has an upper end attached to the second end of the base plate. A façade is removably coupled to the return via at least one fastening device. Each fastening device is configured to be repeatedly fastened and unfastened.

The invention comprises, in another form thereof, a method of assembling a cornice, including providing a substantially U-shaped return and a plurality of façades. Each of the facades is configured to being individually and removably coupled to the return. The return and the facades are packaged in a single package. The package is delivered to a user. The return and the facades are removed from the package. One of the facades is selected and is coupled to the return. The removing, selecting and coupling steps are performed by the user.

The invention comprises, in yet another form thereof, a return for a cornice including a base plate having a first end and a second end. A first side plate includes a top end and a bottom end. The top end includes at least one screw hole alignable with the base plate. A second side plate includes a top end and a bottom end. The top end includes at least one screw hole alignable with the base plate. A first hinge includes a first leg attached to the first end of the base plate and a second leg attached to the top end of the first side plate. A second hinge includes a first leg attached to the second end of the base plate and a second leg attached to the top end of the second side plate.

An advantage of the present invention is that the hard or soft façade may be easily swapped with another type of façade, either hard or soft.

Another advantage is that the return may be pivoted into a compact, low-profile shape for shipping, and then easily pivoted into its operational state.

Yet another advantage is that the facades can be easily removed for cleaning or laundering.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
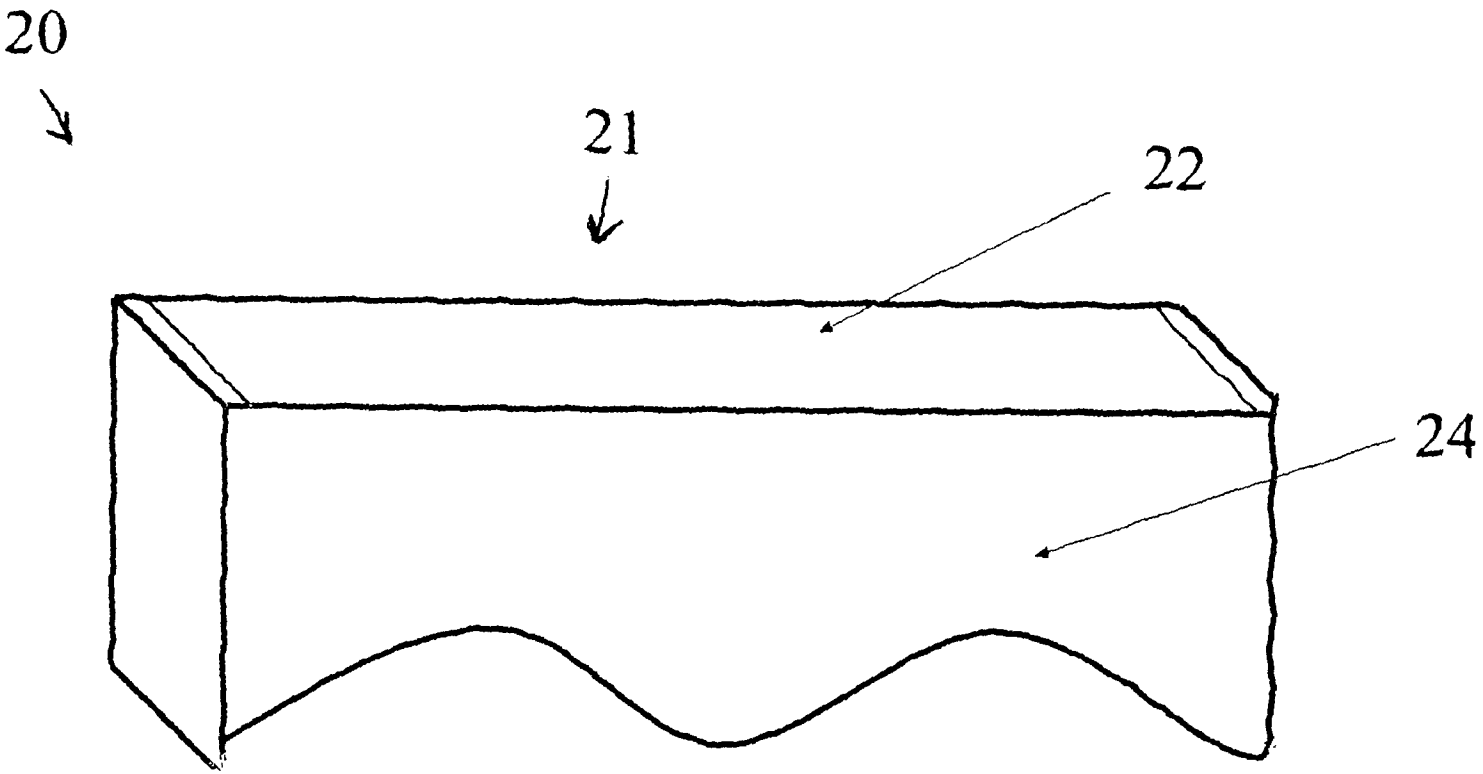
FIG. 1 is a perspective view of one embodiment of a cornice of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figures 2, 3:
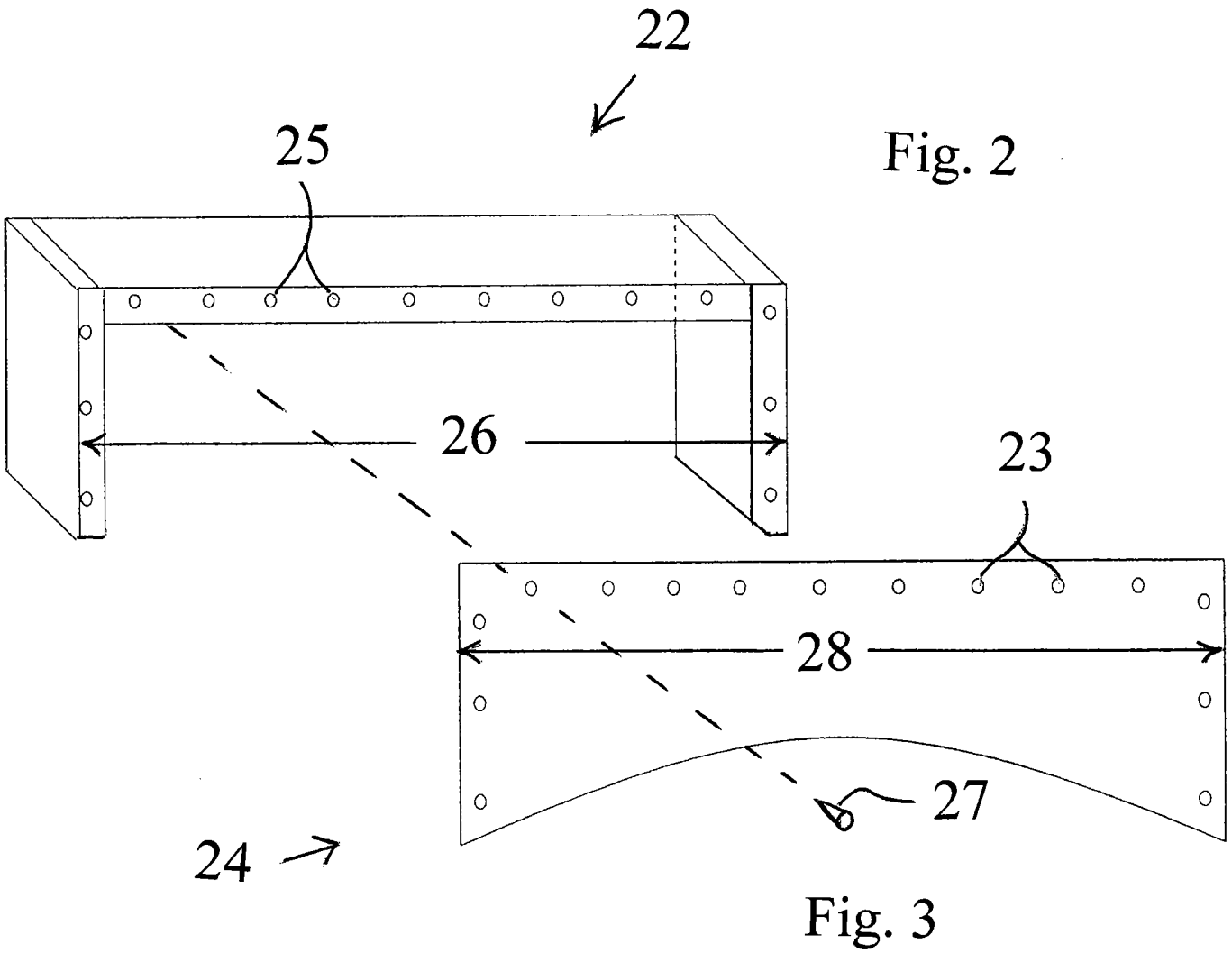
FIG. 2 is a perspective view of the return of the cornice of FIG. 1.
FIG. 3 is a front view of an embodiment of a façade that may be assembled to the return of FIG. 2.

Referring to FIG. 1, there is shown one embodiment of a window cornice kit 20 of the present invention assembled into a hard cornice 21. Window cornice kits of the present invention, which can be hard and/or soft, are top decorative window treatments resembling a box-shaped and/or similar features constructed of various materials; i.e. wood, plastics, etc. Depending on construction, window cornices of the present invention can be covered in many ways, including by covering/upholstering with fabric. In order to cover a cornice, it has to be of sufficient structural strength to support the weight. Two distinct elements of a cornice of the present invention are a U-shaped return 22 (FIG. 2) and a hard front face facade 24 (FIG. 3) that may be disposed on a side of return 22 that is away from the wall/window. The front face facade 24 carries various designs.

Both return 22 and façade 24 may be formed of a fairly rigid or stiff material, such as wood, particle board, or a wood-based panel material, such as MDF, for example.

The perimeter of façade 24 may include through-holes 23, and the edges of return 22 may include corresponding recesses or screw holes 25. Fasteners may be inserted through through-holes 23 and into recesses 25 in order to attach façade 24 to return 22 as discussed in more detail hereinbelow.

Figure 4:
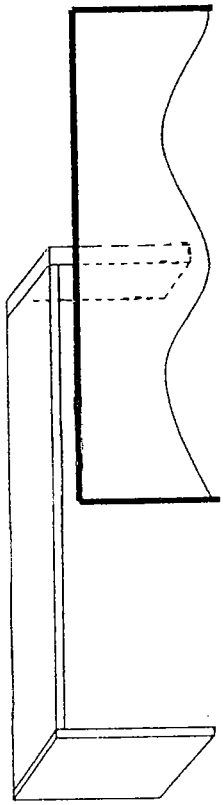
FIG. 4 is a perspective view of the return and the façade of the cornice of FIG. 1 in a disassembled state.
Figure 5A:
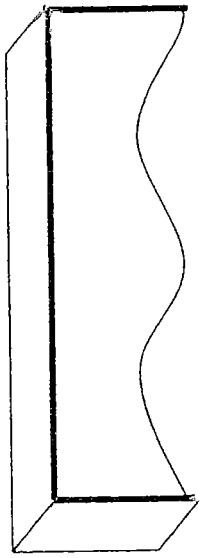
FIG. 5*a* is a perspective view of another embodiment of a cornice of the present invention.
Figure 5B:
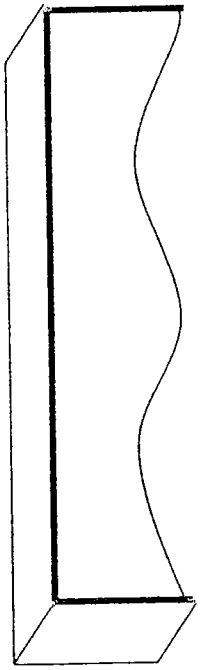
FIG. 5*b* is a perspective view of yet another embodiment of a cornice of the present invention.
Figure 5C:
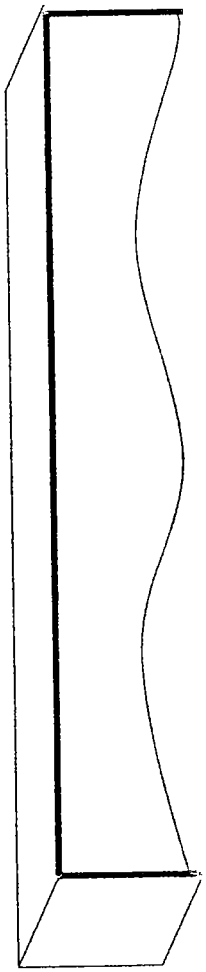
FIG. 5*c* is a perspective view of a further embodiment of a cornice of the present invention.
Figure 7A:
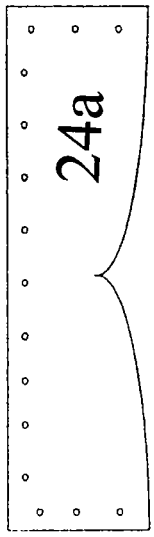
FIG. 7*a* is a front view of another embodiment of a façade of the present invention.
Figure 7C:
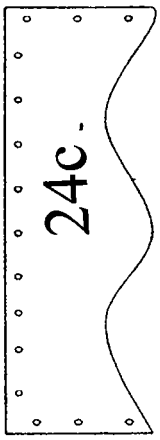
FIG. 7*c* is a front view of still another embodiment of a façade of the present invention.
Figure 7D:
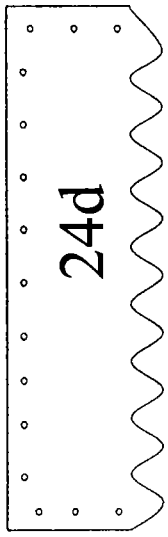
FIG. 7*d* is a front view of a further embodiment of a façade of the present invention.
Figure 7B:
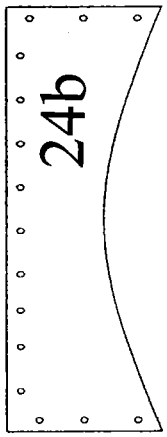
FIG. 7*b* is a front view of yet another embodiment of a façade of the present invention.

Front face facade 24 and return 22 are made separate, but are closely matched in size along contacting surfaces and corresponding dimensions. Regardless of size, a width 26 of return 22 is equal to a width 28 of façade 24. Return 22 and façade 24 of FIG. 4 have equal widths, however the widths of return 22 and façade 24 may vary widely, up to about eight feet, as illustrated in FIGS. 5*a* through 5*c*. Regardless of the magnitude of the width, however, the width of the return may match the width of the façade.

Figure 6:
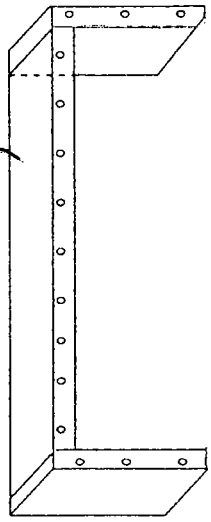
FIG. 6 is a perspective view of another embodiment or a return of the present invention.
Figure 7E:
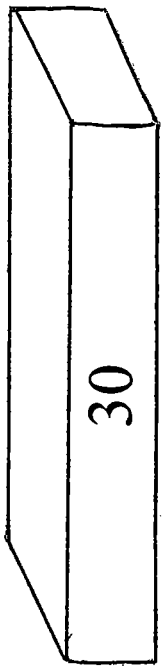
FIG. 7*e* is a perspective view of one embodiment of a package of the present invention.
Figure 15:
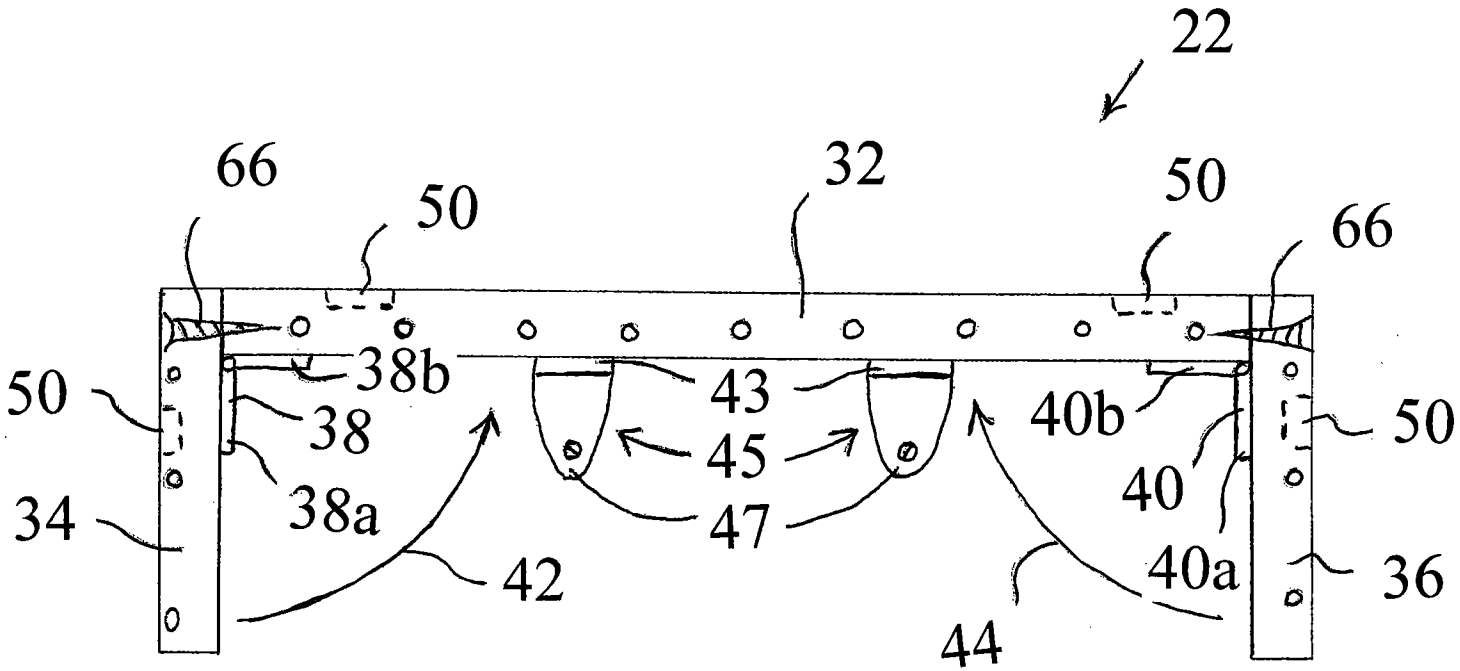
FIG. 15 is a front view of a further embodiment of a return of the present invention that is hung on L-brackets.
Figure 16:
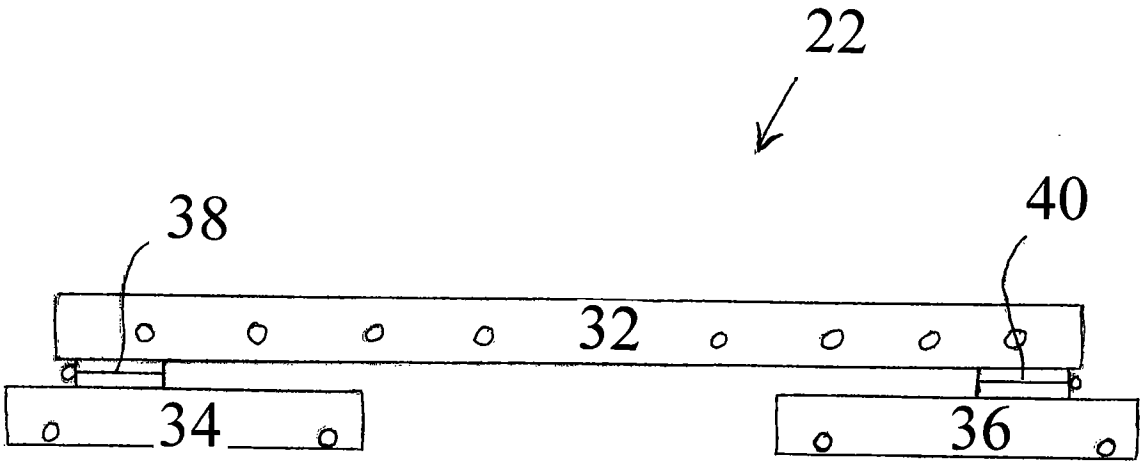
FIG. 16 is a front view of the return of FIG. 15 in a folded-up position for storage or shipping.

During assembly, after determination or choice of size, a kit including a return 22 (FIG. 6) and a plurality of facades 24*a* through 24*d* (FIGS. 7*a* through 7*d*) is made and shipped in a low profile container 30 (FIG. 7*e*). In order to facilitate the low profile of the kit during shipping, a top side or plate 32 of return 22 may be hingedly attached to left-hand side or plate 34 and right-hand side or plate 36 via respective hinges 38, 40. Hinge 38 includes legs 38*a*, 38*b* attached to side plate 34 and base plate 32, respectively. Hinge 40 includes legs 40*a*, 40*b* attached to side plate 36 and base plate 32, respectively. In order to reduce the profile or height of return 22 during shipping, sides 34, 36 may be pivoted in respective directions 42, 44 until sides 34, 36 are parallel to top side 32, as shown in FIG. 16. Upon unpacking return 22 from container 30, the user may pivot sides 34, 36 in directions opposite to directions 42, 44 to place return 22 in the state shown in FIG. 15.

Return 22 may be hung on a wall, such as by hanging top side 32 on upper legs 43 of L-brackets 45 (FIG. 15), the lower legs 47 of which may be screwed into the wall. In this installed state, tope side 32 may be oriented horizontally, and sides 34, 36 may be oriented vertically.

The flat façade 24 may then be attached to the return 22 by the aligning through-holes 23 of façade 24 with recesses 25 of return 22. Non-permanent bonding elements or fasteners, such as flat head, counter sunk screws 27 (FIG. 3), for example, may be inserted through the through-holes 23 and into recesses 25 to thereby secure façade 24 to return 22. The bonding elements or fasteners may be removed, i.e., are removable, such that façade 24 is non-permanently attached to return 22 and may be removed therefrom. Because the front face façade 24 can be removed, various facades, such as facades 24*a-d* may be swapped for each other, and different façade designs can be used, i.e., installed on return 22, at various times.

The ability to swap facades 24 enhances the marketability of kit 20 as the customer can pick and choose from the available front face façade designs, as well as periodically disassemble and rebuild cornice 21 with ease.

An embodiment of a hard cornice 21 and a kit 20 for assembling a hard cornice has been described above with reference to FIGS. 1-7*d*. Below is described an embodiment of a soft cornice and a kit for assembling a soft cornice.

Figures 8, 9:
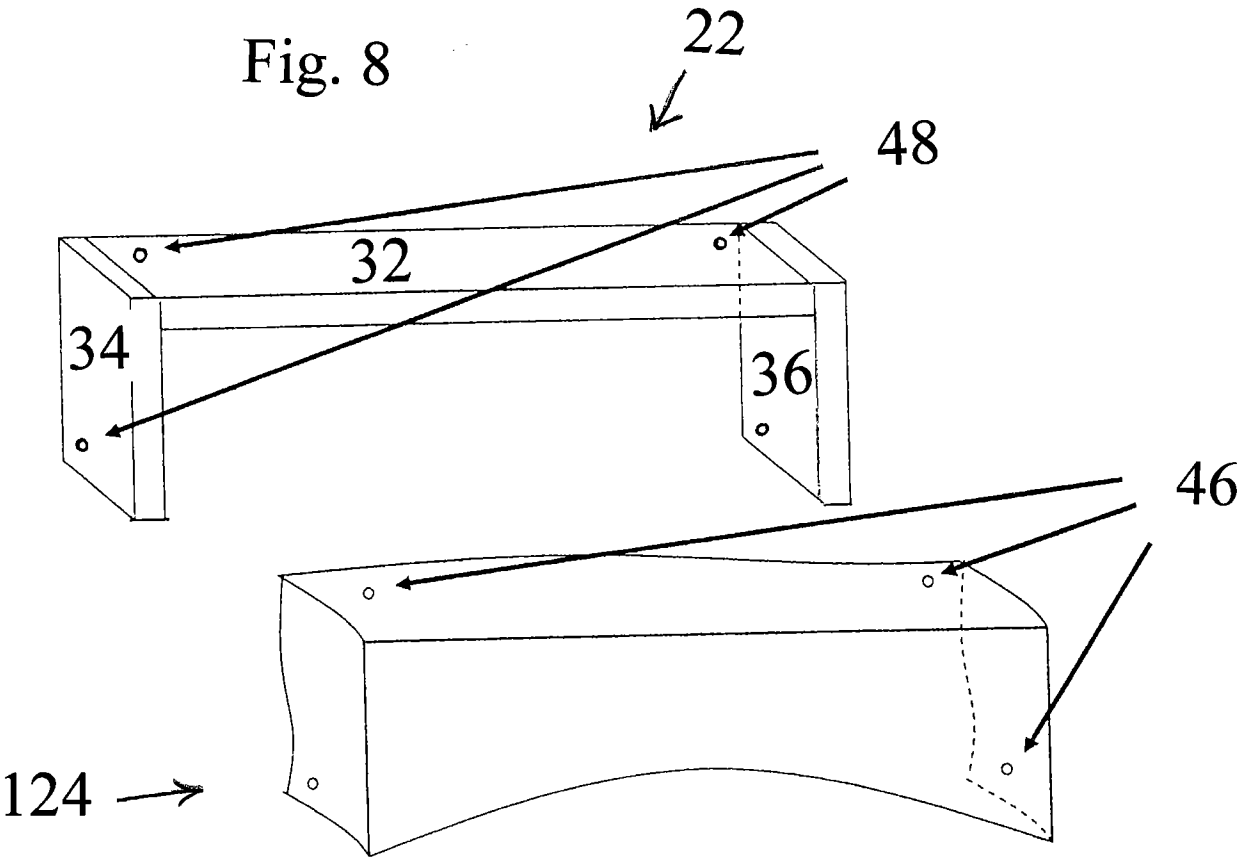
FIG. 8 is a perspective view of another embodiment of a return of the present invention.
FIG. 9 is a perspective view of yet another embodiment of a façade of the present invention.

A more flexible embodiment of a cornice kit of the present invention includes a return 22 (FIG. 8) and a plurality of detachable and re-attachable soft cornice front facades 124, an example of which is shown in FIG. 9. Facades 124 are referred to herein as "soft" because they are made of a soft or flexible material. In one embodiment, facades 124 are formed of a fabric material. The hard front face façade 24 may be replaced by a soft façade 124 in the form of a fully finished tailored fabric resembling a "slip cover".

In the case of a soft façade 124, non-permanent fasteners or bonding elements 46 may be provided on the inner surface of façade 124. Fasteners 46 may be in the form of sewing snaps, metal/magnetic strips, hook and loop fasteners, or magnets sewn into the fabric, for example.

The outer surface of return 22 may be provided with corresponding fasteners or bonding elements 48 at locations on return 22 that are chosen such that, when fasteners 46, 48 are fastened together, façade 124 covers return 22. That is, return 22 may not be visible when covered by façade 124. Fasteners 48 may be in the form of sewing snaps, metal/magnetic strips, hook and loop fasteners, or magnets, for example. Fasteners 48 may be counter sunk into the surfaces of top side 32, left-hand side 34, and right-hand side 36 such that top side 32, left-hand side 34, and right-hand side 36 have substantially smooth, planar surfaces without any fastening elements projecting beyond the planes defined by the surfaces. Fasteners 48 in the form of counter sunk magnets 50 in return 22 are shown in FIG. 15.

Although the locations of the fasteners or bonding elements in the case of soft facades are different from the locations of the fasteners or bonding elements in the case of hard front face facades, the fastening elements on the return and façade may be closely aligned regardless of whether a soft façade or hard façade is employed. That is, in the case of a hard façade, the through-holes and recesses line up in close tolerance. Likewise, in the case of a soft façade, the fastening elements on the return and the soft façade line up in close tolerance.

The non-permanent bonding or fastening elements in the soft cornice covers, i.e., facades 124, are aligned and connected with tight tolerances to the permanent bonding or fastening counter sunk elements on the returns 22. The tight tolerances of the bonding, fastening or connecting elements may provide sharp edges which gives the illusion of a professional hard cornice board finished look. Thus, the cornice of the present invention provides an alternative to an upholstered/covered hard cornice board. In addition, the ease with which the soft facades, i.e., fabric covers, can be removed, and a new, mood appropriate or seasonally correct pattern can be reinstalled, is unparalleled. The present invention also provides for quick and easy cleaning or laundering of such sophisticated window treatments.

Figures 10, 11A, 11B, 11C:
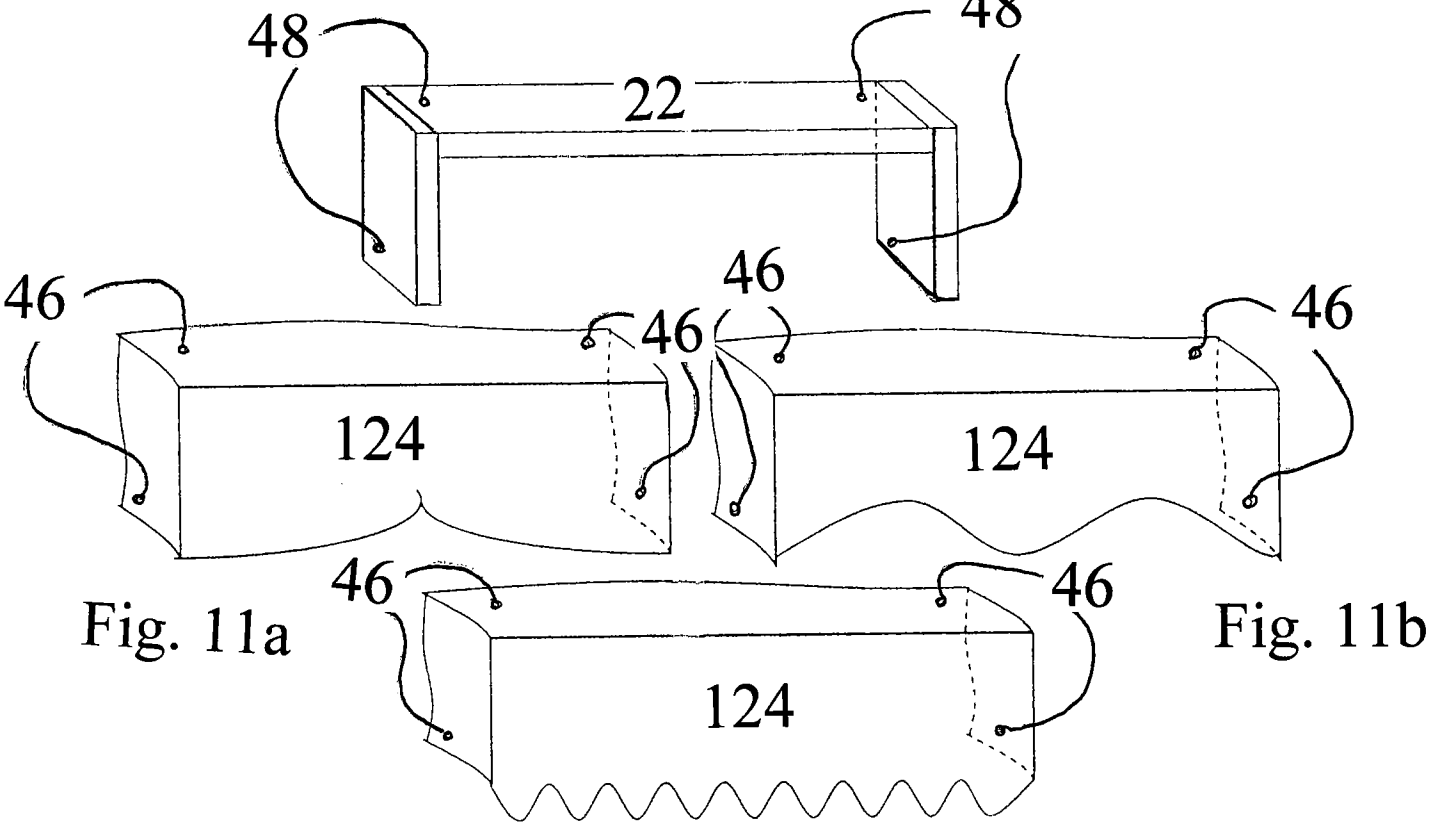
FIG. 10 is a perspective view of another embodiment of a return of the present invention.
FIG. 11*a* is a perspective view of another embodiment of a facade of the present invention.
FIG. 11*b* is a perspective view of yet another embodiment of a facade of the present invention.
FIG. 11*c* is a perspective view of a further embodiment of a facade of the present invention.

A cornice kit of the present invention may include a return 22 with fastening elements 48, as illustrated in FIG. 10, as well as a variety of soft facades 124 (FIGS. 11*a-c*) having corresponding fastening elements 46 at corresponding locations. That is, the covers of FIGS. 11*a-c* fit over return 22. Non-permanent bonding or fastening elements on the soft cornice covers 124 align and connect with bonding or fastening counter sunk elements on the return 22. The fastening elements 48 may be permanently and/or fixedly installed on return 22. Conversely, and at the same time, fastening elements 46 on facades 124 may be non-permanently and/or non-fixedly attached to facades 124.

Figure 12:
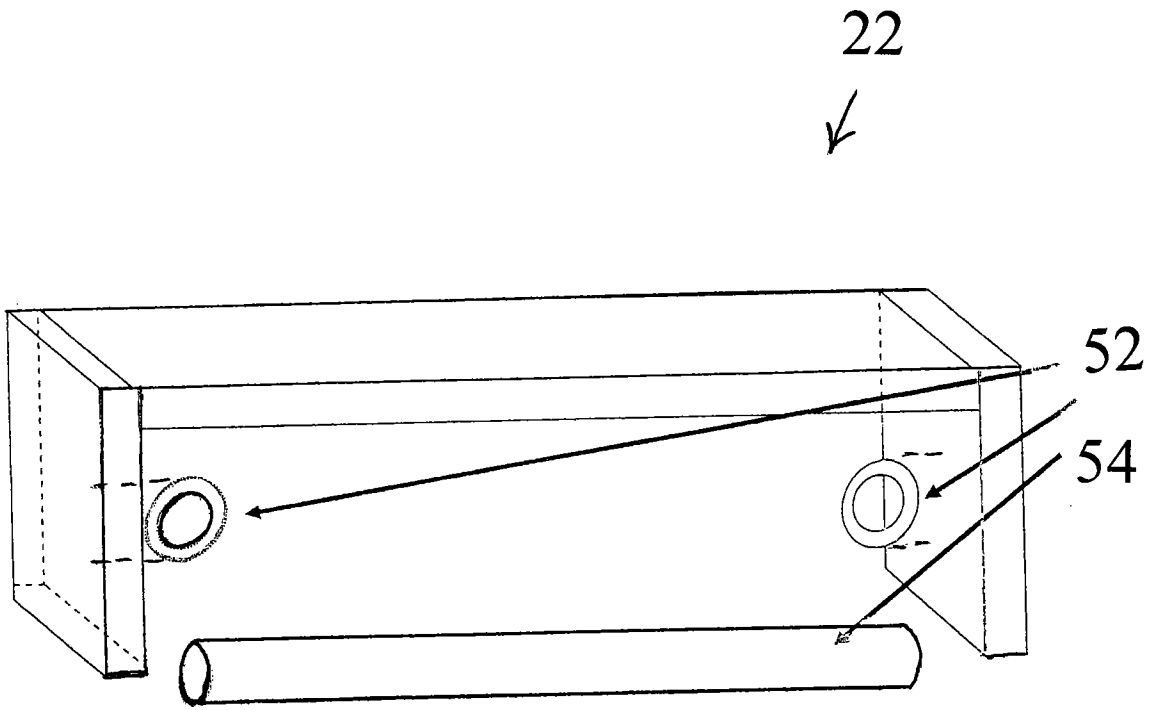
FIG. 12 is a perspective view of another embodiment of a return of the present invention with a dow bar to be mounted thereon.

The hanging of accessories may also be provided for by the present invention. Illustrated in FIG. 12 is the use of wall socket inserts including predrilled holes, screws, and a dow rod holder. The inside of the return may allow for installation of various hardware that enables a product to be displayed under the return. As an example illustrated in FIG. 12, wall socket inserts 52 may be attached to the inner surfaces of left-hand side 34 and right-hand side 36 as indicated by the dashed lines such that inserts 52 may receive and support a dow rod 54. Other fixtures that could be attached to left-hand side 34 and right-hand side 36 include tension rods for sheers, brackets for holding mini blinds, roller shades, roman shades, traverse rods, etc., among other various options. One advantage of installing such fixtures on return 22 is that it avoids installing the fixtures on the walls of a room and the associated need to drill holes in the walls. The hardware can be offered as an optional element of the cornice kit for both hard and soft cornices. Commercially available brackets are standardized in their size and shape, and thus predrilled holes can be provided in left-hand side 34 and right-hand side 36 in order to aid the installation of such upgrades. Alternatively, hardware can be installed in the pre-assembly stage and can be shipped with the kit as requested by the customer.

Figure 13:
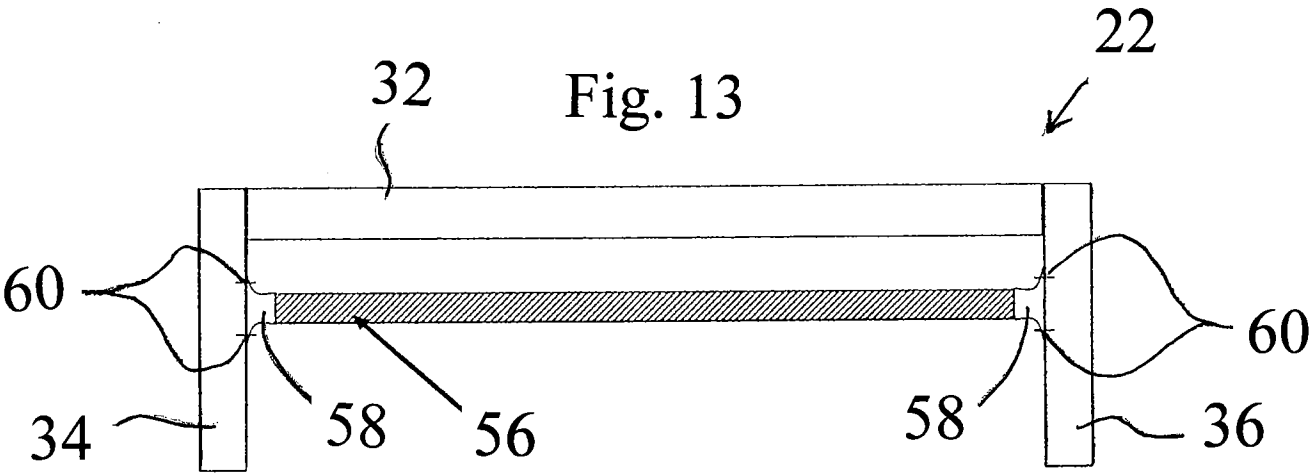
FIG. 13 is a front view of yet another embodiment of a return of the present invention with a dow bar mounted thereon.
Figure 14:
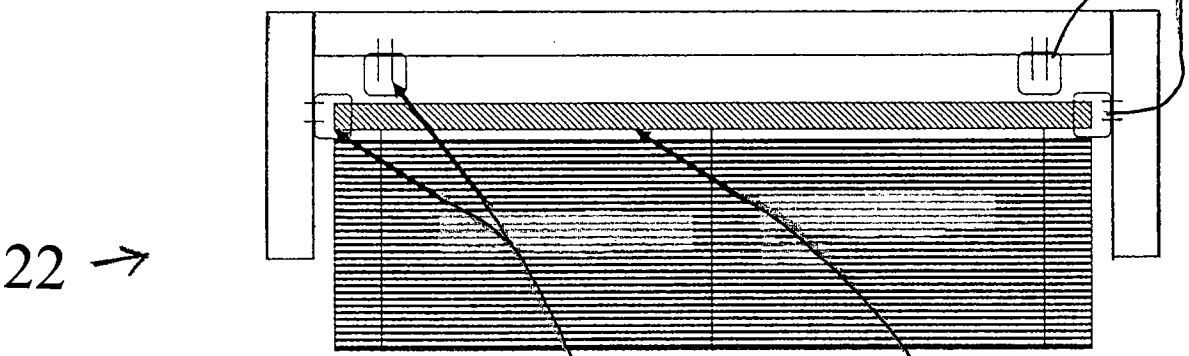
FIG. 14 is a front view of still another embodiment of a return of the present invention with a mini blind mounted thereon.

Other hardware examples for using returns for supporting accessories are shown in FIGS. 13 and 14. In the example shown in FIG. 13, a tension rod 56 is used for hanging sheers, curtains, or other hangable material. Tension and traverse rods such as rod 56 can be inserted into brackets 58 for use in hanging sheers and curtains. Brackets 58 may be screwed into left-hand side 34 and right-hand side 36, as indicated at 60.

In another example illustrated in FIG. 14, bracket holders 62 are attached to return 22 for supporting blinds. More particularly, bracket holders 62 may support a mini blind top 64. Bracket holders 62 may be used for supporting mini blinds, roman shades, roller shades, etc. Bracket holders 62 can also be installed on the undersurface of top side 32 and/or on the inner surfaces of left-hand side 34 and right-hand side 36 of return 22. As examples of different combination can be utilized, a tension rod may be installed on the inner surfaces of left-hand side 34 and right-hand side 36 for supporting sheers. Alternatively a tension rod may be installed on the undersurface of top side 32 for supporting blinds and their bracket holders.

In the case of a soft façade 124, return 22 does not receive structural reinforcement from the façade, as it does from a hard façade 24 that is fastened to the edges of return 22. Thus, after left-hand side 34 and right-hand side 36 have been pivoted to the position shown in FIG. 15, screws 66 may be inserted through left-hand side 34 and right-hand side 36 and into top side 32 in order to hold or fix return 22 in the position shown in FIG. 15. Multiple screws 66 may be used to fix left-hand side 34 to top side 32, with the screws being aligned in a direction into the page of FIG. 15. Likewise, multiple screws 66 may be used to fix right-hand side 36 to top side 32, with the screws being aligned in a direction into the page of FIG. 15. Screws 66 may be counter sunk such that they do not project beyond the outer surfaces of left-hand side 34 and right-hand side 36. Through-holes may be provided in left-hand side 34 and right-hand side 36 for receiving screws 66, as shown in FIG. 15. These through-holes may be aligned with base plate 32 such that screws 66 can screw into base plate 32, as also shown in FIG. 15. Further, pre-drilled screw holes may be provided in top side 32 for receiving screws 66.

A kit of the present invention may include a return 22 and both a variety of hard facades 24 and a variety of soft facades 124. That is, it is possible for a soft façade 124 to be swapped with a hard facade 24 on a given return 22. Likewise, it is possible for a hard façade 24 to be swapped with a soft facade 124 on a given return 22.

Facades 24 and facades 124 are described herein as being interchangeable with other facades by virtue of the ease of repeatedly fastening and unfastening one or more of fasteners 27, 46, 48. For example, screws 27 may be repeatedly screwed and unscrewed for purposes of swapping facades 24. In one embodiment, fasteners 46 may be unfastened by a single unidirectional force. For example, a user may grab a fastener 46 and unfasten fastener 46 by a single pull of fastener 46 in a single direction.

In a method of assembling a cornice of the present invention, a return and a plurality of hard and/or soft facades may be packaged in a single package 30 that is delivered to the consumer user. The return may include recesses 25 for attachment of hard facades as well as fasteners 48 for attachment of soft facades. Other fasteners, such as screws 27, 66 may be included in package 30. The user may remove the contents of package 30 and select a façade for coupling to the return. Later, the user may choose to decouple the façade from the return, selected another façade, and then couple the newly selected façade to the return.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A cornice, comprising:

a substantially U-shaped return including:

a substantially horizontal base plate having a first end and a second end;

a first substantially vertical plate having an upper end attached to the first end of the base plate; and a second substantially vertical plate having an upper end attached to the second end of the base plate, wherein an outwardly-facing surface of the base plate, an outwardly-facing surface of the first substantially vertical plate and/or an outwardly-facing surface of the second substantially vertical plate includes at least one counter sunk first magnet; and a façade removably coupled to the return via at least one second magnet, wherein each said second magnet is configured to be coupled to a respective said first magnet.

2. The cornice of claim 1 wherein the upper end of the first substantially vertical plate is attached to the first end of the base plate via a first hinge and via at least one first screw extending through the first substantially vertical plate and into the base plate, the upper end of the second substantially vertical plate is attached to the second end of the base plate via a second hinge and via at least one second screw extending through the second substantially vertical plate and into the base plate.

3. The cornice of claim 2 wherein the cornice is configured to be shipped without the first and second screws being attached to the base plate and with the first and second substantially vertical plates being parallel to the base plate and hingedly attached to the base plate.

4. The cornice of claim 1 further comprising a dow bar having a first end mounted to the first plate and a second end mounted to the second plate.

5. The cornice of claim 1, wherein the return and the façade have substantially equal widths.

* * * * *